US005615424A

United States Patent [19]

Nakata

[11] Patent Number: 5,615,424

[45] Date of Patent: Apr. 1, 1997

[54] EARTHQUAKE-PROOF BED

[76] Inventor: Kenji Nakata, c/o Sanken General Commercial Co., Ltd., 3-24 Kyomachi, Toyooka, Hyogo, Japan

[21] Appl. No.: 518,933

[22] Filed: Aug. 24, 1995

[30] Foreign Application Priority Data

Jun. 28, 1995 [JP] Japan ..... 7-007530

[51] Int. Cl.[6] ..... A47C 19/22; A47C 29/00

[52] U.S. Cl. ..... 5/2.1; 5/308; 5/400; 5/414; 52/79.1; 52/263

[58] Field of Search ..... 5/414, 2.1, 308, 5/400; 52/167.3, 79.6, 79.1, 263

[56] References Cited

U.S. PATENT DOCUMENTS

| | | | |
|---|---|---|---|
| 2,607,047 | 8/1952 | Posey | 5/2.1 |
| 4,069,527 | 1/1978 | Harris | 5/514 |
| 4,259,755 | 4/1981 | Hollander | 5/308 |
| 4,490,864 | 1/1985 | Wicker, Jr. | 5/2.1 |
| 4,782,541 | 11/1988 | Tuchman | 5/414 |
| 4,965,895 | 10/1990 | Shustov | 5/414 |
| 5,005,230 | 4/1991 | Congdon | 5/308 |
| 5,095,566 | 3/1992 | Russell | 5/308 |

FOREIGN PATENT DOCUMENTS 59-48098 11/1984 Japan .

*Primary Examiner*—Alexander Grosz
*Attorney, Agent, or Firm*—Keck, Mahin & Cate

[57] ABSTRACT

An earthquake-proof bed having a superior endurance property is constructed of approximately box-shaped metallic panels and contains necessities in the event of an earthquake, such as tools for escaping and food in tool boxes installed under the bed. This earthquake-proof bed includes box-shaped metallic panels. Each panel is shaped with a plurality of frames and a pair of metal plates fixed on both sides of the frames. A plurality of tool boxes is installed on the bottom metallic panel. The plurality of tool boxes is formed by dividing plates. A plurality of lids covers the tool boxes, and an opening is shaped on any one of the metal panels. Bedding is provided on the lids.

13 Claims, 7 Drawing Sheets

EARTHQUAKE-PROOF BED

BACKGROUND OF THE INVENTION

This invention relates to an earthquake-proof bed of superior compressive and earthquake-proof structure and, in particular, to an earthquake-proof bed suitable for securing human life in the event of a serious earthquake which collapses buildings and houses.

up to the present, conventionally popularized beds have been designed and developed for enabling comfortable sleep, not taking into consideration the idea of guarding sleeping people from disastrous earthquakes.

Accordingly, when severe earthquakes occur and housing collapses, it is impossible to escape from the collapsed houses because the residents are crushed thereunder. In fact, as shown in the recent Great Hanshin Earthquake, it was impossible to cope with such a disastrous earthquake as 3600 people, or approximately 70% of those perishing in the disaster, were crushed to death.

This invention was developed in consideration of the above, and an object thereof is to provide an earthquake-proof bed able to safeguard human beings while sleeping, even in a severe earthquake.

A further object of this invention is to provide an improved earthquake-proof bed providing required facilities for an earthquake by providing sufficient space in the bed for holding necessities, such as tools for escaping, food, a portable radio, etc., in the event of an emergency such as the above-mentioned severe earthquake.

BRIEF DESCRIPTION OF THE INVENTION

In order to attain the above objects, an earthquake-proof bed according to this invention is comprised of a box structured with six metallic panels, plurality tool boxes shaped with a plural of dividing plates, fixed on the bottom metallic panel of the metallic panels and plural lids for closing the tool boxes which should be beneath the mattress. An entrance opening is shaped on either of the metallic panels. The bed is characterized in that it is constructed with bedding provided on the plurality of lids.

Further, the metallic panels are constructed with metallic frames and plural metallic plates fixed on both sides of the frames.

The above frames and metallic plates can be made of titanium alloys.

Further, the above frames and metallic plates can be made of stainless steel.

More further, the above frames and metallic plates can be made of high-tension steel.

Still further, the above frames and metallic plates can be made of steel.

Further yet, the above frame and metallic plates can be made of silicon-carbide alloy.

The present invention is an earthquake-proof bed constructed in an approximately box-shape with six metallic panels. The metallic panels of the front, rear and side surfaces of the metallic panels are assembled on the bottom metallic panel and fixed to each other.

There is provided a plurality of tool boxes divided by the dividing plates at a specified level on the bottom metallic panel, and the bed is further shaped by providing a plurality of lids covering the tool boxes and installing bedding on the lids.

Further provided is a ceiling metallic panel shaping the top of the box bed and the opening on the front metallic panel or side metallic panels, and the opening of the front metallic panel is defined as the entrance of the box bed.

Hereupon, the openings shaped on the side metallic panels are provided for giving a feeling of openness to the person sleeping in the bed.

The metallic panels shaping the above external panels are reinforced with vertical, horizontal and oblique frames for holding the required strength of each panel, and further provided with metallic plates on both sides thereof.

Further, by constructing the above-mentioned frames and metallic plates with high-tension metals such as titanium alloy, stainless steel, high-tension steel, silicon carbide alloy or aluminum alloy, and by providing them with sufficient strength against miscellaneous external forces loaded on the box-shaped bed, this invention aims to secure the lives of those sleeping in the bed or taking refuge in the bed in the event of the collapse of houses due to a severe earthquake.

In particular, by providing an earthquake-proof bed according to the present invention able to hold four to five persons per single bed and 6–7 per double bed, if there were one in every home, early rescue becomes possible by using the tools in the tool boxes of the bed and waiting for the opportunity to escape, even in a severe earthquake that collapses houses.

DETAILED DESCRIPTION OF THE INVENTION

Figure 1:
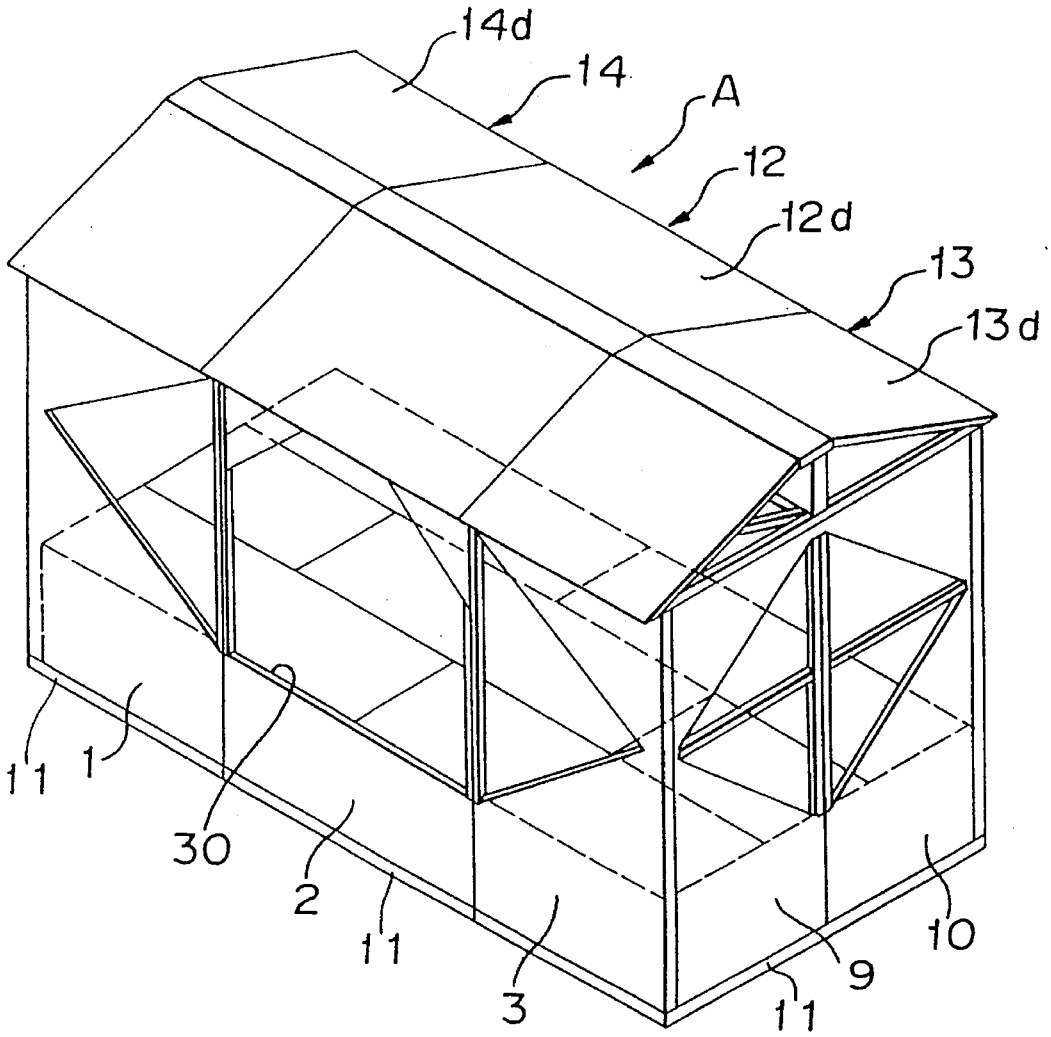
FIG. 1 is a perspective view of the earthquake-proof bed according to the present invention.
Figure 2:
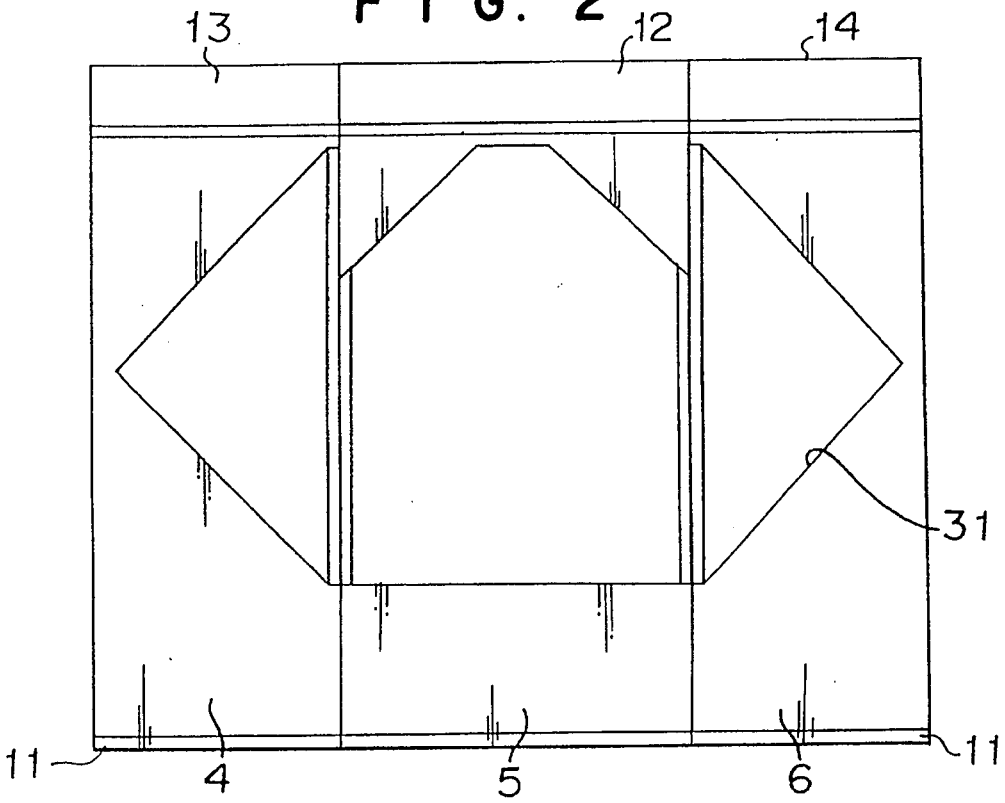
FIG. 2 is a side perspective view of the earthquake-proof bed according to the present invention.
Figure 3:
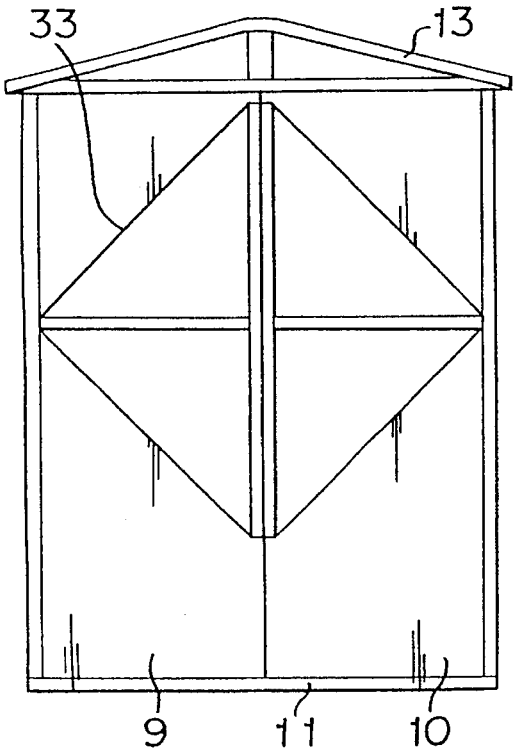
FIG. 3 is another side perspective view of the earthquake-proof bed according to the present invention.
Figure 4:
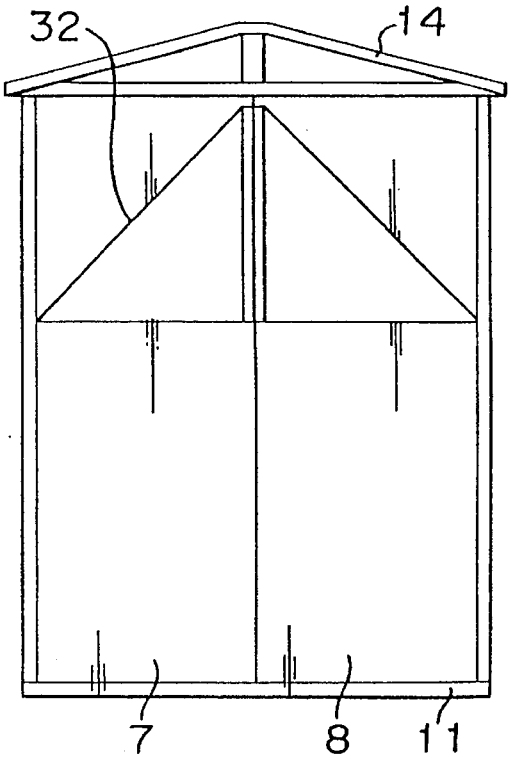
FIG. 4 is also a side perspective view of the earthquake-proof bed according to the present invention.
Figure 5:
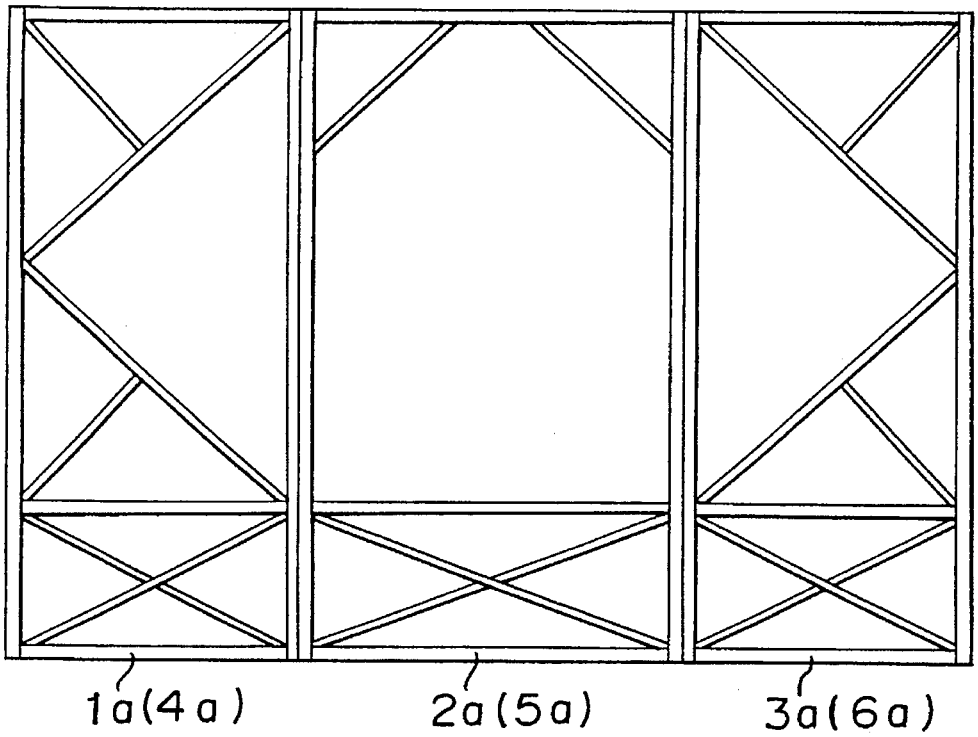
FIG. 5 shows frame structures of the metallic panels of the earthquake-proof bed according to the present invention.
Figure 6:
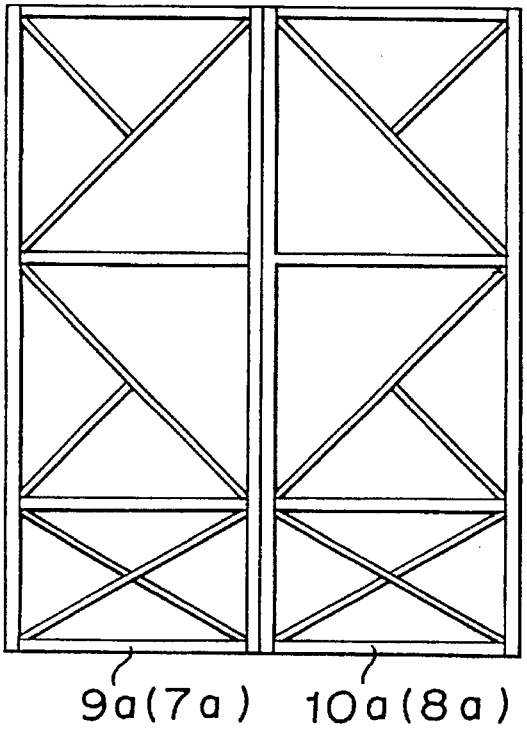
FIG. 6 also shows frame structures of the metallic panels.
Figure 7:
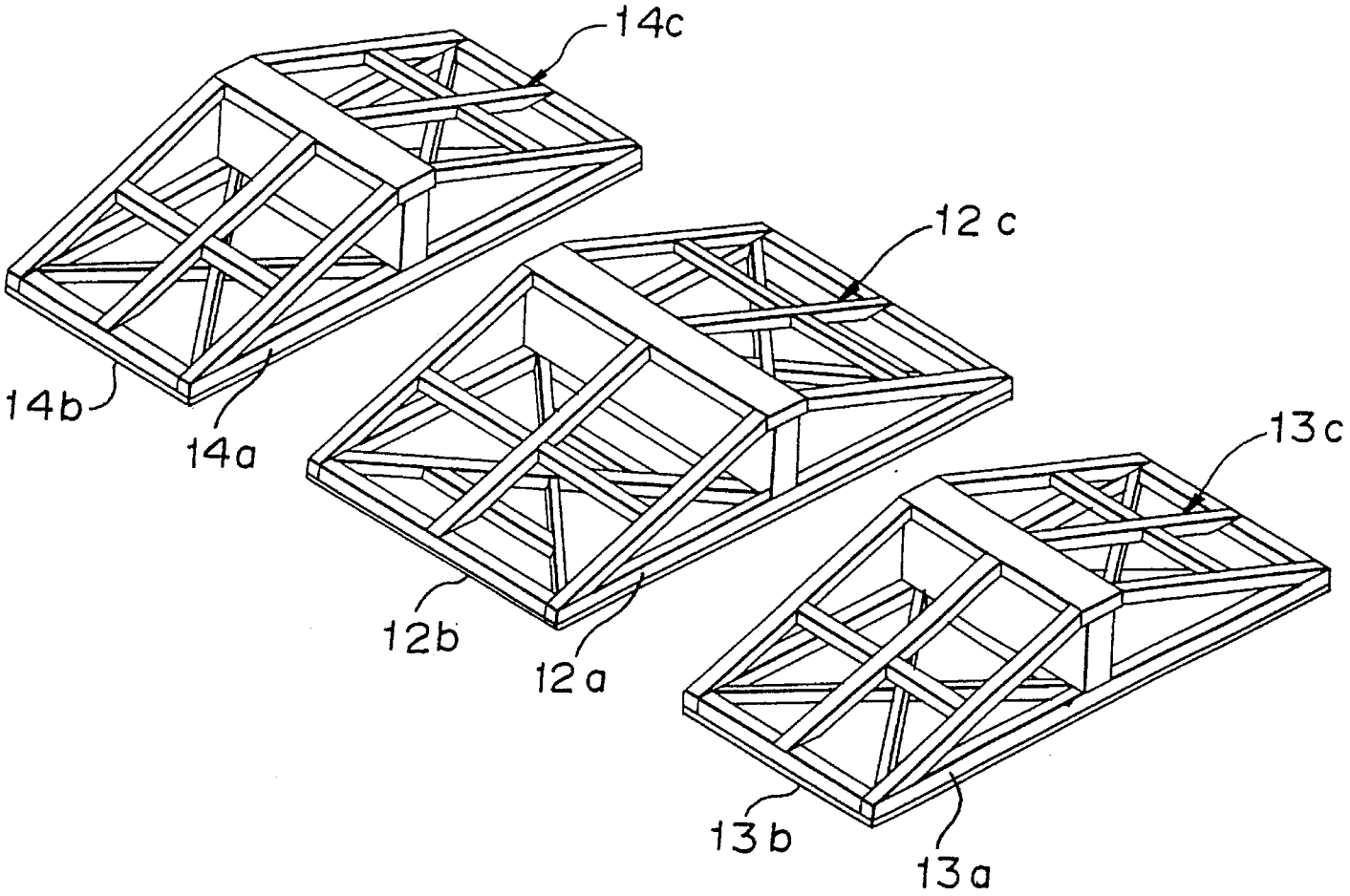
FIG. 7 is a perspective view of the frame structure of the top of the earthquake-proof bed of the present invention.

In the Figures, the letter A is the earthquake-proof bed which is approximately box-shaped (hereafter referred to as "the bed"), and the bed A is shaped approximately as a box with front metallic panels 1, 2 and 3, rear metallic panels 4, 5 and 6, a pair of side metallic panels 9 and 10, a bottom metallic panel 11 consisting of three pieces, and three ceiling metallic panels 12, 13 and 14 (ceiling means).

A plurality of tool boxes 20 each divided by a plurality of dividing plates 11*a*, is shaped on the bottom metallic panel 11. The numeral 21 is a plurality of lids covering the tool boxes 20, and the lids 21 are shaped so as to suit every tool box 20.

Figure 8:
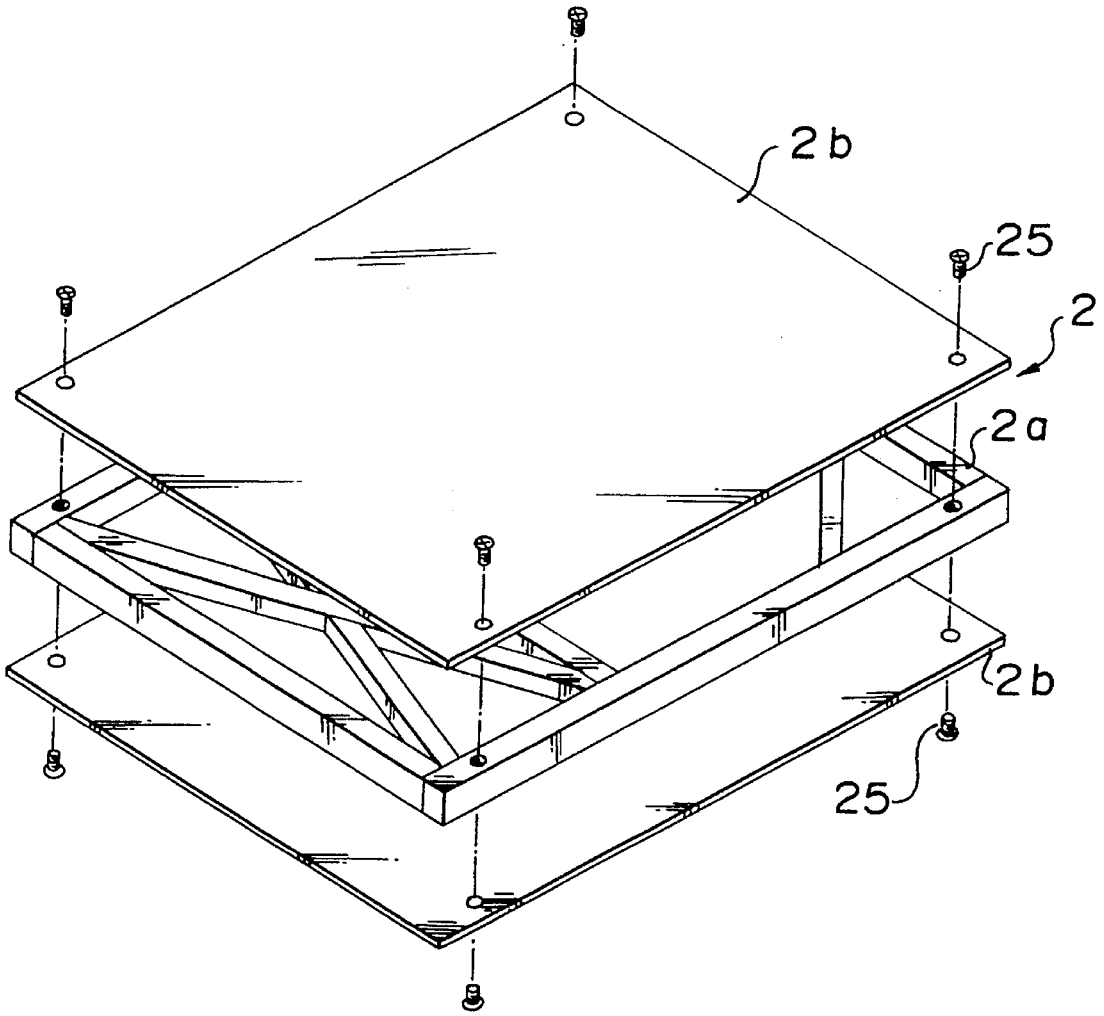
FIG. 8 is an exploded view of the metallic panels according to the present invention.
Figure 9:
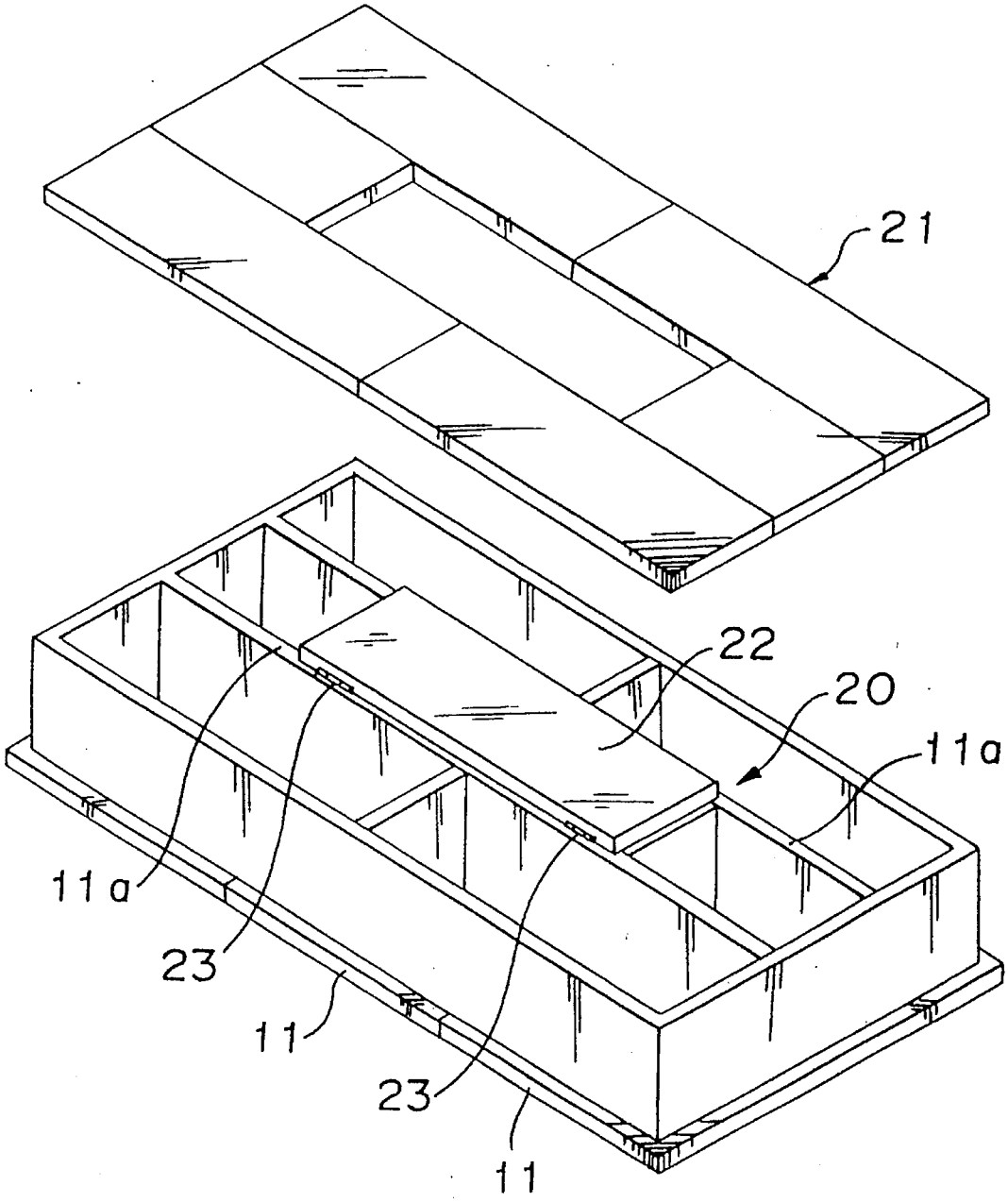
FIG. 9 is perspective views of the tool boxes and the lids thereof according to the present invention.

The numeral 22 shown in FIG. 9 is a lid installed on the tool box 20 by applying a pair of hinges 23, and a sunken handle is shaped on the nearly center portion of the lid 22. Further, as shown in FIGS. 2, 3, 4, 5, 6 and 10, each of the aforementioned metallic panels 1 through 10 is constructed with each of frames 1*a* through 10*a* horizontally, vertically and diagonally installed, and each of the metallic plates which are fixed on each sides of the frames. FIG. 8 shows a typical example of the metallic panel 2. The panel 2 is assembled by connecting metallic panels 2*b* and 2*b* on a frame 2*a* with a plurality of bolts 25. Regarding metallic panels 12, 13 and 14, ceiling metallic panels 12, 13 and 14 are structured by installing metallic panels 12*b*, 13*b* and in back of frames 12*a*, 13*a* and 14*a*, respectively, roof-shaped frames 12*c*, 13*c* and 14*c* (although other shapes, for example a half-circle shape, may also be used) on the frames 12*a*, 13*a* and 14*a*, respectively, and metallic plates 12*d*, 13*d* and 14*d* over the roof-shaped frames. The numeral 30 is an opening windowed on the front panels 1, 2 and 3, the numeral 31 is an opening windowed on the rear panels 4, 5 and 6, the numeral 32 is an opening windowed on the side panels 7 and 8, and the numeral 33 is an opening windowed on the side panels 9 and 10.

The box-shaped bed A is constructed in a rectangular shape in accordance with a standard human body, and the external dimensions of the bottom metallic panel 11 are designed so as to be larger than the external dimensions of the tool boxes 20 as much as the dimensions on which the metallic panels are constructed and fixed. Namely, the tool boxes 20 are fittingly assembled on the bottom metallic panel 11.

Further, a plurality of lids 21 and 22 is installed on the tool boxes 20 having the same specified heights, and a bed is shaped by placing a spring and/or mattress on the lids 21 and 22 arranged parallel and in a plane.

As shown in FIG. 1, ceiling metallic panels 12, 13 and 14 are fixed on the above edges of the box-shaped bed A constructed as described above, and the bed A is made approximately box-shaped completely surrounded by metallic panels on all sides.

Further, openings 30 through 33 may be shaped freely in accordance with the user's preference.

Figure 10:
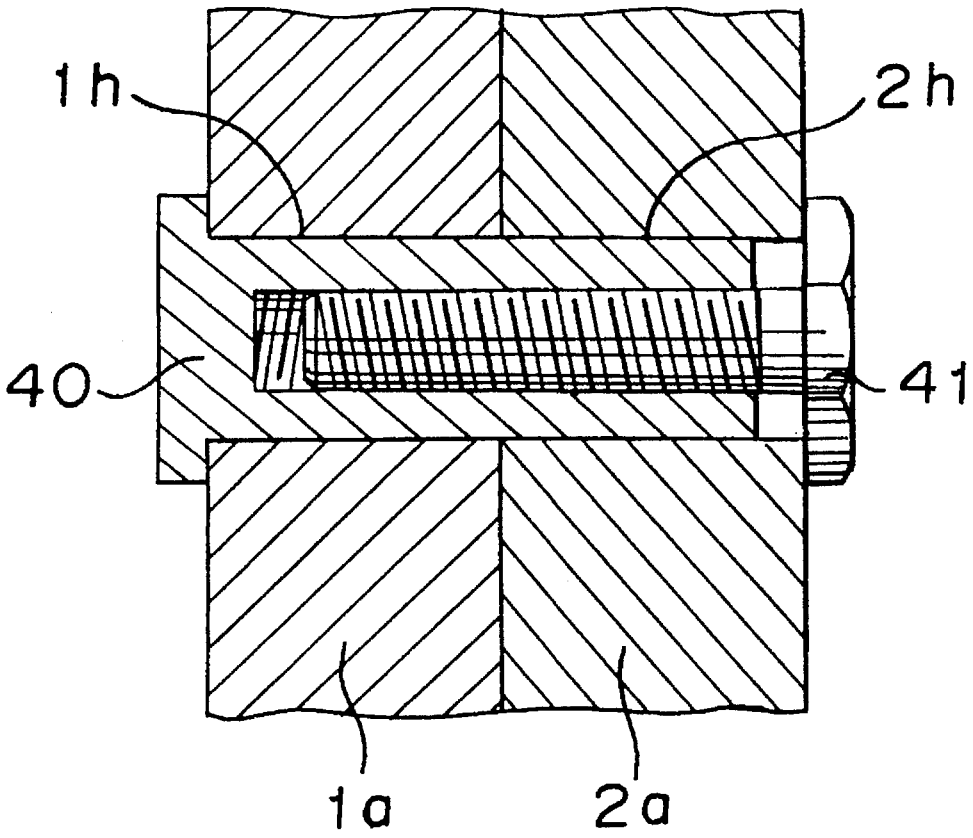
FIG. 10 is a fragmental cross-section of the panel connection.

A connection of the metallic panels is illustrated by FIG. 10 below. Rectangular solid holes 1*h* and 2*h* are made on the metallic frames 1*a* and 2*a*, nuts 40 which should receive bolts 41 are inserted into the holes 1*h* and 2*h*, and a bolt 41 is screwed into the nuts 40 to connect the panels 1 and 2. The aforementioned metallic panels 1 through 13 are respectively strongly constructed with frames and metallic plates fixed on at least one side of each panel, and further metallic members constructing this bed are selectable from a titanium alloy, aluminum alloy, stainless steel, high-tension steel, or silicone-carbide alloy. Accordingly, as this box-shaped bed A is able to resist upper and horizontal external forces without massive deformation, especially external force due to falling furniture or columns during building collapse in a severe earthquake, it becomes possible to guard the lives of the persons in the bed.

The bed of the invention is constructed with 16 metallic frames for the explanation of the invention, but the number of frames is not limited to the above. Frame structures and metallic materials may be changed in accordance with usages, i.e., in wooden houses or in concrete buildings.

The tool box 20, mounted on the bottom metallic panel 11, is divided into a plural of small boxes by partitioning plates 11*a*. It becomes possible to prevent mingling of the articles contained therein, and deviation of them in one direction due to the earthquake, by dividing the tool box as mentioned above. Also, it becomes possible to fully prepare for an earthquake by providing necessities for the earthquake in these tool boxes.

As necessities for an earthquake, for example, drinking water for 5 days and food for 5 days are stored in quantities sufficient for one person. In addition, a speaker, a watch, three batteries, two large hand saws, one first-aid kit, a pair of large and small hammers, a large bar, a searchlight, a siren, a multi-lantern with radio, two steel cutting saws (larger sized), a chisel for cutting stones, a raincoat, three sheets each having 3m×3m lengths, fives shoes etc. are stored.

Further, the box-shaped bed A is usable as shelter in the event of a severe earthquake. For example, it is possible to hold 4–5 people in a single bed, and 6–7 people in a double bed.

Although this bed is prepared for a severe earthquake, it is preferable to consider also its coloring and to make it attractive to the user, as this bed is also an item of furniture which is used every day.

In this embodiment, 12 colors (cream, red, yellow, green, blue, gold, silver, black, dark blue, brown, vermilion, gray) are colored by baking as a selected bed color. The bed is ready to beautify the room as one of the pieces of furniture.

Further, it may be possible to cover the openings 30 through 33 shaped on the metallic panels with desired curtains.

As this earthquake-proof bed according to the present invention is constructed with the metallic panels shaped with the frame made of titanium alloy, etc., and assembled approximately box-shaped, it is provided with enough strength to withstand external forces weighted diagonally, up and down and right and left. The bed is prevented from collapse and substantial deformation from falling items, columns or debris in a severe earthquake, and it becomes possible to securely guard the lives of the persons sleeping in the bed.

Further, it is possible to use this earthquake-proof bed as shelter from the earthquake, and to attain superior effects for safely securing human life.

Further, even in the event that a person is trapped in the space of this bed covered by debris due to the collapse of a house or building, it becomes possible to escape from this bed by oneself by using the hammers and saws taken out from the tool boxes installed under the lower portion of the bed, and in the event that it is impossible to escape by oneself, it becomes possible to ascertain the surrounding circumstances by using the radio set, and to call for rescue by using the speaker and the searchlight stored in the tool boxes.

What is claimed is:

1. An earthquake-proof bed comprising:

a plurality of metallic panels disposed in a particular shape and including a three piece bottom metallic panel, front metallic panels, rear metallic panels and side metallic panels;

a plurality of tool boxes fixed on the bottom metallic panel;

said plurality of tool boxes being divided by a plurality of dividing plates;

a plurality of openable lids covering said tool boxes;

at least one opening in each of said front, rear and side metallic panels; and bedding installed on said plurality of lids and forming, together with said metallic panels, said tool boxes and said lids, the earthquake-proof bed.

2. An earthquake-proof bed as claimed in claim 1, wherein said metallic panels are constructed with a plurality of frames made of metal and a plurality of metallic plates fixed on at least one side of each of said frames.

3. An earthquake-proof bed as claimed in claim 2, wherein said frames are made of titanium alloy.

4. An earthquake-proof bed as claimed in claim 2, wherein said frames are made of stainless steel.

5. An earthquake-proof bed as claimed in claim 2, wherein said frames are made of high-strength steel.

6. An earthquake-proof bed as claimed in claim 2, wherein said frames are made of steel.

7. An earthquake-proof bed as claimed in claim 2, wherein said frames are made of silicon-carbide alloy.

8. An earthquake-proof bed as claimed in claim 2, wherein said metallic plates are made of a titanium alloy.

9. An earthquake-proof bed as claimed in claim 2, wherein said metallic plates are made of stainless steel.

10. An earthquake-proof bed as claimed in claim 2, wherein said metallic plates are made of high-strength steel.

11. An earthquake-proof bed as claimed in claim 2, wherein said metallic plates are made of steel.

12. An earthquake-proof bed as claimed in claim 2, wherein said metallic plates are made of silicon-carbide alloy.

13. An earthquake-proof bed as claimed in claim 1, wherein at least one of said lids is openably installed on said dividing plates via hinges.

* * * * *